US005520134A

United States Patent [19]

Walker

[11] Patent Number: 5,520,134

[45] Date of Patent: May 28, 1996

[54] DOCKING AID APPARATUS

[76] Inventor: Raymond G. Walker, 32 Howland La., Hingham, Mass. 02043

[21] Appl. No.: 494,951

[22] Filed: Jun. 26, 1995

[51] Int. Cl.[6] ..... B63B 21/00

[52] U.S. Cl. ..... 114/230

[58] Field of Search ..... 114/230, 221 R, 114/218; 116/63 P

[56] References Cited

U.S. PATENT DOCUMENTS

| | | | |
|---|---|---|---|
| D. 313,544 | 1/1991 | Scherer | D8/355 |
| 3,120,831 | 2/1964 | Fulton | 114/230 |
| 3,151,595 | 10/1964 | Stainbrook | 114/230 |
| 3,952,690 | 4/1976 | Rizzo et al. | 116/63 P |
| 4,073,255 | 2/1978 | Paul | 114/230 |
| 4,280,440 | 7/1981 | Barton | 114/230 |
| 4,462,329 | 7/1984 | Brushaber | 114/230 |
| 4,676,182 | 6/1987 | Chaiko | 114/230 |

FOREIGN PATENT DOCUMENTS

| | | | |
|---|---|---|---|
| 2226998A | 7/1990 | United Kingdom | 114/230 |

*Primary Examiner*—Sherman Basinger
*Attorney, Agent, or Firm*—John P. McGonagle

[57] ABSTRACT

A vertical, flexible, fiberglass rod removably attached to a dock. The rod has a resilient line holder attached near to the top of the rod. Reflective tape is applied to the rod for increased visibility, even during nighttime. The line holder retains a spring line, which is secured at one end to the dock, in a coil until removed when docking.

2 Claims, 2 Drawing Sheets

DOCKING AID APPARATUS

BACKGROUND OF THE INVENTION

This invention is related to mooring devices, and more particularly to an apparatus for which aids in the mooring of a boat at a boat dock.

There are two general objectives in docking a boat in a slip. The objectives are: to prevent the boat from going too far forward and damaging the boat and/or dock, and to prevent the boat from involuntarily blowing, or being carried, out of the dock once in the general area of being secured. One of the best ways to accomplish these objectives is to secure a spring line attached at one end to a dock cleat to the boat being docked at a position approximately at the boat's midpoint on the side of the boat nearest the dock. As the boat moves forward the slack in the spring line tightens up and automatically brings the boat into the dock broadside. When the line is tight the forward motion of the boat is also stopped. At this point, if no one is available on the dock to pass up other lines, the operator holds the boat to the dock by maintaining slow forward Rpm on the engine thereby allowing someone aboard to get down on the dock to secure other required lines.

One of the major problems in the operation of a boat is that of safely docking a boat weighing many tons, 10–15 tons is typical. An automobile is provided with brakes to accomplish stopping. However, a boat has very limited means to stop forward motion at the right point, among them reversing the engine, gradual loss of momentum, and, lastly, brute strength. Unlike an automobile, there are factors experienced by boaters which in large part cancel out the skill of an operator. On the ocean, there are unfriendly winds and currents that alter the forward motion of a boat in an adverse way. A tail wind will accelerate forward motion. A cross wind will radically change a boat's position as it approaches a dock to either closer or farther away than desired. An ocean's current will do exactly the same to a boat's forward movement but in an even less desirable way.

The prior art contains many devices which attempt to assist boaters in their docking operations. Typical among these is U.S. Pat. No. 4,280,440 (Barton). Barton discloses a boat mooring apparatus comprised of a resilient rod with a hook attached thereto pivotal attached to a dock. The hook holds a bumper pad attached by means of a first cord to the base of the rod. A second cord is attached at one end to the base of the rod and the other end by means of a loop to the hook thereby bending the rod over. A horizontal bar is fixedly attached to the rod. The purpose of the bar is to engage an approaching boat and pivot the rod so that the rod hook is overhanging the water and positioned so that the boat's operator may access the two cords. The Barton apparatus is complex and limited under adverse conditions. Fenders hanging from the side of a boat could easily engage the apparatus if the boat were too close to the dock due to cross wind, tide or operator error, thereby interfering with the mooring operation. Lines are easily entangled and adjustment of lines is not possible. If proper contact is not made on forward movement of the boat, the mooring operation will fail.

Another device typical of the prior art is U.S. Pat. No. 4,676,182 (Chaiko). Chaiko discloses a flexible limb attached to a dock at one end and having a mooring line hook attached to the opposite end thereof. The hook has a weighing container pendantly attached thereto for suspension therefrom, thereby bending the limb so that the loop end of a mooring line may be suspended from the hook. As with the Barton patent, the Chaiko apparatus is limited under adverse conditions. Fenders hanging from the side of a boat could easily engage the suspended weight container if the boat were too close due to cross wind, tide or operator error, thereby interfering with the mooring operation. Lines are easily entangled and adjustment of lines is not possible. If proper contact is not made on forward movement of the boat, the mooring operation will fail.

SUMMARY OF THE INVENTION

In view of the foregoing disadvantages inherent in the known types of devices now present in the prior art, the present invention provides an mooring aid. As such, the general purpose of the present invention, which will be described subsequently in greater detail, is to provide a new and improved mooring aid which is simple and flexible in its use.

To attain this, the present invention provides a vertical, flexible, fiberglass rod removably attached to a dock. The rod has a resilient line holder attached near to the top of the rod. Reflective tape is applied to the rod for increased visibility, even during nighttime. The line holder retains a spring line, which is secured at one end to the dock, in a coil until removed when docking. A deckhand reaches out from an approaching boat to grasp any part of the spring line and, regardless, if there is still line left on the line holder, a horizontal pull will release the entire coil, down to where the other end of the spring line is secured to the dock. The free end of the spring line is secured to the boat deck at a predetermined length that will automatically bring the boat into the dock and not allow it to collide with the dock at the boat front (bow). The invention does not obstruct the path of a boat in any way as prior art devices do. It is "clean" with the face of the dock, i.e., it will not catch onto any part of an approaching boat. Installation and removal are simple. The materials are weather-proof and safe.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
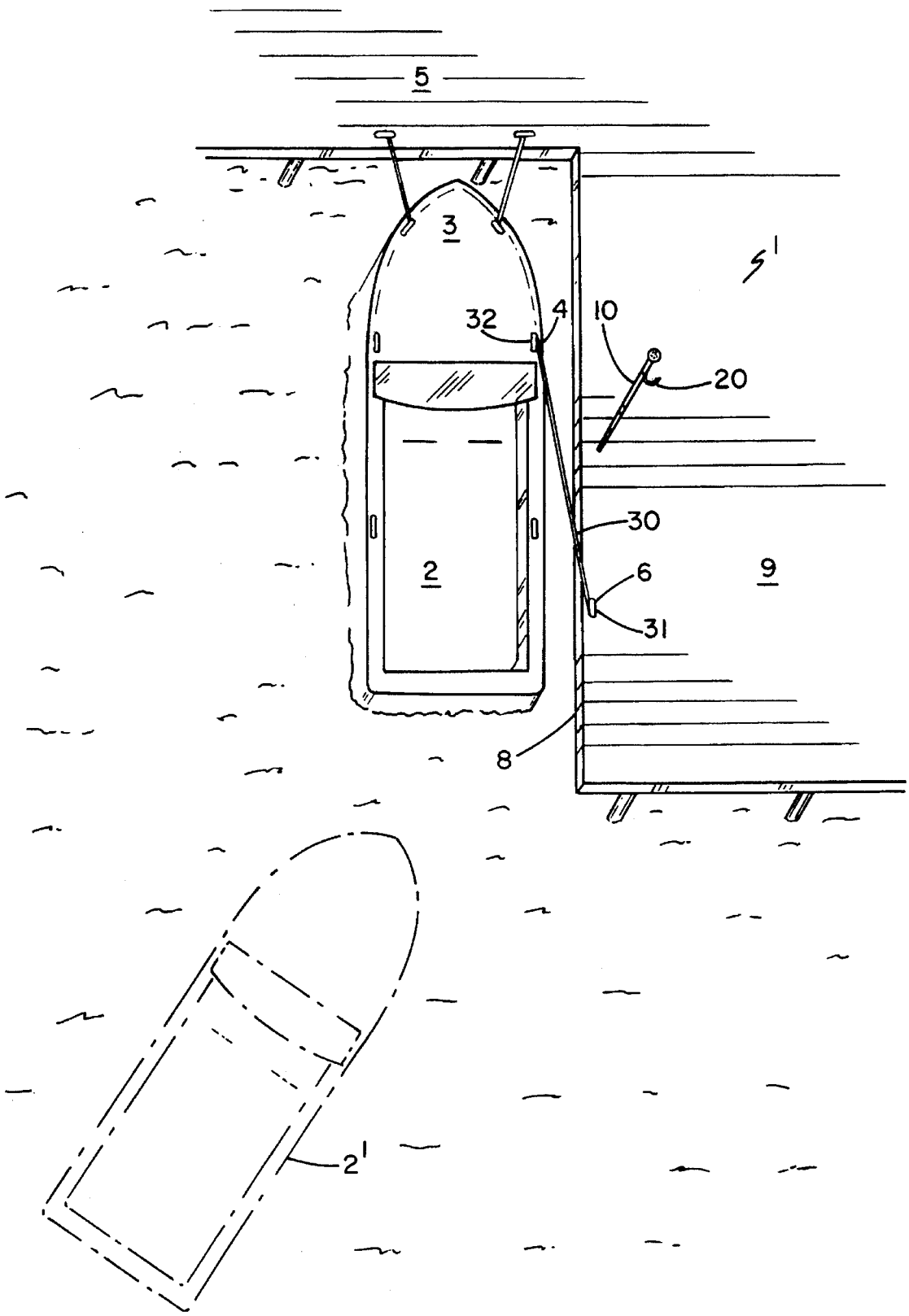
FIG. 1 is a perspective view of one embodiment of an arrangement constituting the invention for mooring a boat in a dock slip and particularly illustrates the disposition of the arrangement as the boat enters the dock slip.

Referring to the drawings in detail wherein like elements are indicated by like numerals, there is shown an embodiment of the invention 1 incorporating a docking aid apparatus to assist in mooring a boat 2. The invention 1 is comprised of a vertical, straight, ½ inch diameter, five foot length, fiberglass rod 10 with a line holder 20 attached thereto. The length of the rod 10 may be extended or shortened, depending upon the need. Fiberglass is used as the material of choice because it is extremely flexible and, if struck while docking, will bend without breaking. Fiberglass is also nearly impervious to weather conditions.

The rod 10 has a top end 11 and a bottom end 12. The rod 10 is removably installed on a dock 9 by drilling a ½ inch vertical hole 7 in the dock 9 to a depth of 2½ inches. If the dock 9 does not allow proper depth, a two-by-four pad can be secured to the planking of the dock 9. The bottom end 12 of the rod 10 is inserted into the hole 7. In this invention embodiment two strips 13 of reflective tape are attached to the rod 10 at various desired locations along the rod 10. The tape 13 is especially helpful at night in providing a boat operator an excellent reference point to determine the side 8 of the dock 9. A unique reference marker 14 may be attached to the top 11 of the rod 10. In this embodiment of the invention 1, a colored ball 14 is glued to the rod top 11. The ball 14 may be of various colors and patterns to assist a boat operator in identifying his particular slip.

The line holder 20 is attached to the rod 10 approximately ten inches below the rod top end 11. The line holder 20 has an upper neck portion 21 and a hook-shaped lower portion 22. The line holder 20 is comprised of 5/16 inch diameter, size AWG4 600 volt, black, electrical wire. The wire is comprised of soft annealed stranded copper conductor encased in PVC insulation, which in turn is encased in a nylon jacket. The line holder 20 is strong enough to hold a spring line 30 but flexible enough to release the line 30 when a pulling pressure is applied to the line 30. Being black, the line holder 20 is UV resistant to sun exposure. The line holder 20 also has excellent abrasion, chemical, gasoline and oil resistance. It has excellent resistance to most chemicals, solvents or fumes. As stated above, the line holder lower portion 22 is bent into the general shape of a hook. The type of wire used in the line holder 20 has a "memory" which retains its bent configuration nearly indefinitely. The line holder 20 is secured to the rod 10 by means of stainless steel wire 25 wrapped about the neck 21 of the line holder 20. An eight inch length of shrinkable polyolefin tubing 26 is positioned over the wire-wrapped line holder neck 21 and rod 10 and shrunk tight by a heat gun. The resiliency of the invention line holder 20 and its ability to return substantially to its original shape provide the unique and novel characteristic of this invention 1.

Figure 3:
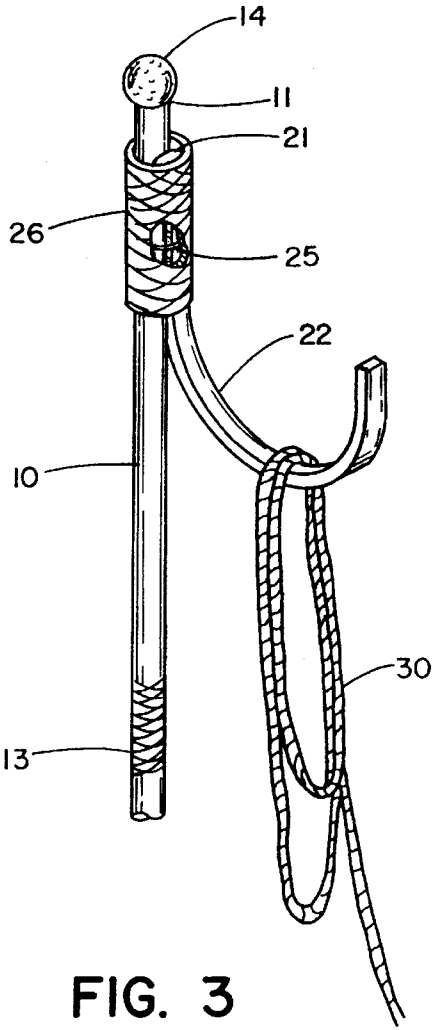
FIG. 3 is a close up view of the line holder portion of the invention, partly in section.
Figure 2:
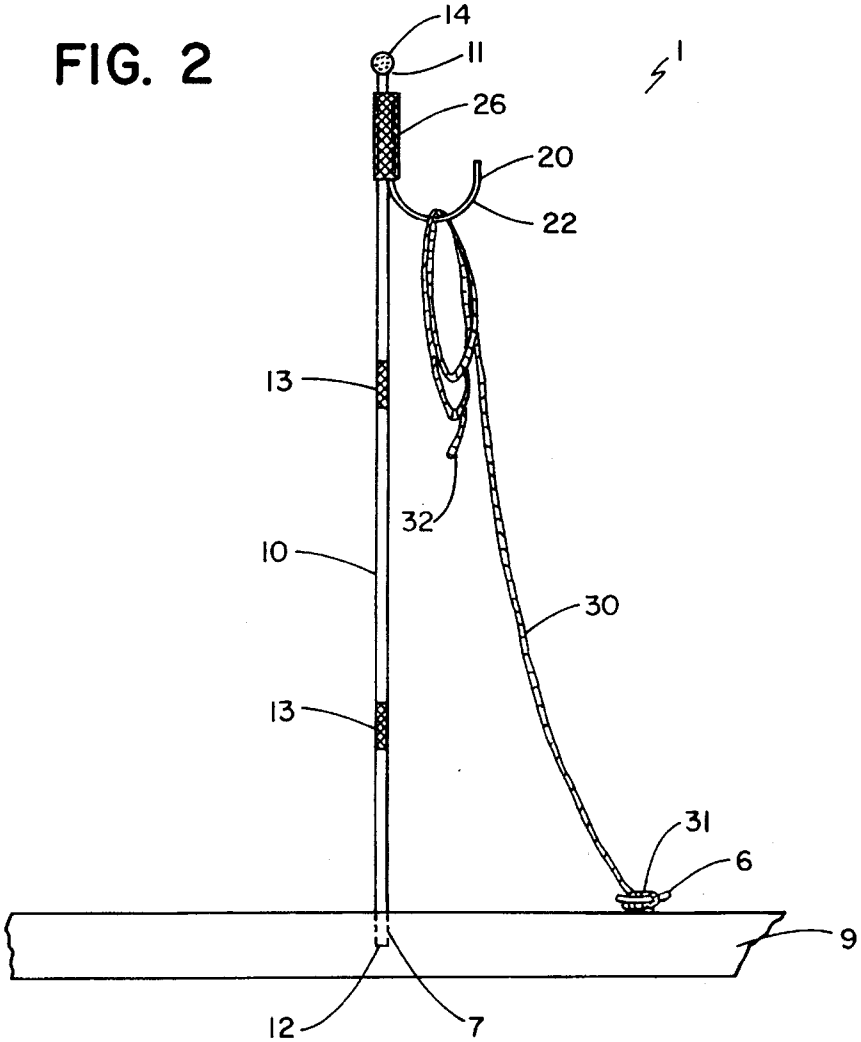
FIG. 2 is a side view of the invention embodiment shown in FIG. 1.

As may be seen in FIGS. 2 & 3, the spring line 30 is attached at one end 31 to a cleat 6 attached to the dock 9. The remainder of the spring line 30 is coiled and hung on the invention line holder 20. Referring now also to FIG. 1, a boat 2' approaches the dock 9 bow 3 first. As the boat 2 approaches the dock 9 a deckhand reaches out from the boat side 4 to grasp any part of the spring line 30 the deckhand can reach. A horizontal pull will release the unattached portion of the coiled spring line 30. The flexible nature of the line holder 20 nearly eliminates entanglements often experienced with prior art devices. The spring line free end 32 is then secured on the boat deck at a predetermined length that will automatically bring the boat 2 into the dock side 8 and also prevent the boat bow 3 from colliding with the portion 5 of the dock 9 at the bow 3 of the boat 2.

It is understood that the above-described embodiment is merely illustrative of the application. Other embodiments may be readily devised by those skilled in the art which will embody the principles of the invention and fall within the spirit and scope thereof.

I claim:

1. An apparatus for aiding the mooring of a boat at a boat dock, said boat dock having a cleat attached to said boat dock and a spring line having a free end and an end attached to said cleat, comprising:

a straight, vertical, flexible, weather-impervious, fiberglass rod having a top end, a bottom end, and a cylindrical body interconnecting said ends; said rod bottom being removably attached to said dock, said rod body having reflective tape applied thereto;

a resilient, line holder having a straight, upper neck portion and a hook-shaped lower portion, said upper neck portion being attached to said rod body near to the top end of the rod, said line holder being adapted to hold in its hook-shaped portion an unattached portion of said spring line in a coil until removed when mooring a boat, said line holder hook-shaped portion being adapted to return substantially to its original shape if said line holder's lower portion hook-shape is distorted during mooring, wherein said line holder is comprised of:

a soft annealed stranded copper conductor,

PVC insulation encasing said conductor, a black nylon jacket encasing said PVC insulation encased conductor, a stainless steel wire wrapped about the line holder neck portion and said rod body thereby securing said line holder to said rod, and a length of shrinkable polyolefin tubing positioned over the wire-wrapped line holder neck and rod body, said tubing having been shrunk tight by an external heat source; and a unique reference marker attached to the top end of the rod.

2. An apparatus as recited in claim 1, wherein:

said a unique reference marker attached to the top end of the rod is comprised of a colored ball glued to the top end of the rod.

* * * * *